US007270239B1

(12) United States Patent
Ross

(10) Patent No.: US 7,270,239 B1
(45) Date of Patent: Sep. 18, 2007

(54) DENTAL STAIN PREVENTER

(76) Inventor: Karen L. Ross, 974 Evergreen La., Port Hueneme, CA (US) 93041-2651

( * ) Notice: Subject to any disclaimer, the term of this patent is extended or adjusted under 35 U.S.C. 154(b) by 407 days.

(21) Appl. No.: 11/029,513

(22) Filed: Jan. 6, 2005

(51) Int. Cl.
*B65D 71/00* (2006.01)

(52) U.S. Cl. ..... 206/581; 206/277; 206/83; 206/823; 132/308; 132/311

(58) Field of Classification Search ..... 206/581, 206/277, 83, 530, 532, 63.5, 484, 803, 823, 206/828, 229, 230, 361, 219
See application file for complete search history.

(56) References Cited

U.S. PATENT DOCUMENTS

| | | | | |
|---|---|---|---|---|
| 2,673,362 | A * | 3/1954 | Robinson | 401/186 |
| 3,075,639 | A * | 1/1963 | Lingley | 206/366 |
| D266,633 | S | 10/1982 | Wink | |
| 4,527,574 | A | 7/1985 | Manfredi | |
| 4,530,129 | A * | 7/1985 | Labick et al. | 15/184 |
| 4,628,949 | A | 12/1986 | Mas et al. | |
| 4,880,111 | A * | 11/1989 | Bagwell et al. | 206/209.1 |
| 5,001,803 | A * | 3/1991 | Discko, Jr. | 15/167.1 |
| 5,028,158 | A * | 7/1991 | Fey | 401/183 |
| 5,040,553 | A | 8/1991 | Londono et al. | |
| 5,044,386 | A | 9/1991 | Nelson | |
| 5,181,531 | A | 1/1993 | Escoto et al. | |
| 5,184,719 | A * | 2/1993 | Gordon | 206/209.1 |
| 5,423,427 | A | 6/1995 | Brown | |
| 5,775,511 | A * | 7/1998 | Stark | 206/760 |
| 5,954,996 | A * | 9/1999 | Discko, Jr. | 252/79.1 |
| 6,009,886 | A * | 1/2000 | Labranche et al. | 132/309 |
| 6,062,233 | A * | 5/2000 | Williams | 132/309 |
| 6,311,837 | B1 * | 11/2001 | Blaustein et al. | 206/362.2 |
| 6,325,076 | B1 | 12/2001 | Ramirez | |
| 6,364,665 | B1 | 4/2002 | Trettenero | |
| 6,401,727 | B1 * | 6/2002 | Carroll | 132/286 |
| 6,463,937 | B1 * | 10/2002 | Cloutier et al. | 132/309 |
| 6,682,722 | B2 * | 1/2004 | Majeti et al. | 424/53 |
| 2003/0203338 | A1 | 10/2003 | Levine | |
| 2006/0228158 | A1 | 10/2006 | Levine | |

* cited by examiner

*Primary Examiner*—Mickey Yu
*Assistant Examiner*—Steven Pollicoff
(74) *Attorney, Agent, or Firm*—Marshall A. Lerner; Marvin H. Kleinberg; Kleinberg & Lerner, LLP

(57) ABSTRACT

A compact personal package for tooth stain prevention between regular brushings includes a small brush and a small quantity of specially formulated cleaning material enables a user to immediately remove stain-causing substances from the teeth and freshen the breath as promptly as possible after exposure to such substances, so as to prevent the stain from setting in. A first embodiment is directed to a disposable product for essentially one-time usage, while a second embodiment is directed to a re-usable product. Variations in packaging are provided for maximum personal convenience as well as for commercial distribution efficiency. The products offer substantial promotional potential as complimentary guest gifts in restaurants, motels and hotels, as well as retain items directed to the general public.

10 Claims, 4 Drawing Sheets

DENTAL STAIN PREVENTER

FIELD OF THE INVENTION

The present invention relates to the field of dental hygiene, particularly as applied to preservation of good facial appearance. The invention is directed to prevention of discoloration of particularly the front tooth region by facilitating removal therefrom of common residual staining substances between regular brushings, promptly after exposure to such substances.

BACKGROUND OF THE INVENTION

Undoubtedly, facial appearance is of prime importance to most individuals, and is greatly enhanced by the appearance of clean white teeth. Conversely, facial appearance is greatly degraded by stain discoloration that develops over time from the cumulative effects of frequent and repeated exposures to staining substances, despite normal regular brushings.

Modern lifestyles, including increased public travel trends, have tended to intensify the exposure of many to teeth-staining substances such as nicotine, coffee and many other beverages and foods. Due to lack of convenient facilities, often the period between regular brushings can extend to as much as 16 hours or more. Consequently, especially for the appearance-conscious, there is an unfulfilled need for a convenient way to remove these unwanted residuals from at least the frontal areas of the teeth as promptly as possible after each of numerous incidents of daily exposures between regular brushings.

DISCUSSION OF KNOWN ART

Many approaches to portable devices or kits for enabling regular brushing when away form home include U.S. Pat. Nos. 6,325,076, 4,527,574, 5,044,386, 5,423,427 and D266, 623. Fingertip type toothbrushes have been disclosed in U.S. Pat. Nos. 4,628,949 having a fingertip receptacle and stored in a hinged lid case along with a solid bar of cleaning compound, and in U.S. Pat. No. 5,181,531 having an attached finger-activated tooth-paste tube, intended as a disposable kit for vending machines.

As an example of a remedial device, U.S. Pat. No. 6,364,665 discloses a TOOTH WHITENING KIT AND METHOD OF USING THE SAME, used to apply a tooth whitening composition to a user's teeth.

In contradistinction from the above described known art the present invention is directed to a novel and evolving philosophy of personal super-prevention to be practiced as required throughout every day whether at home or in travel as a supplement to conventional maintenance, i.e. regular brushings, so as to avoid or at least minimize a potential later need for remedial procedures such as whitening, wherein unduly harsh abrasives or strong chemicals can remove enamel or cause other damage to the teeth.

OBJECTS OF THE INVENTION

It is a primary object of the invention to provide products and methods directed to prevention of tooth discoloration by facilitating immediate removal of residue from the front region of the teeth as quickly as possible after each exposure to staining residues to prevent stain from setting in permanently, especially in locations and situations where conventional brushing is impractical.

It is a secondary object to provide a compact embodiment, capable of simple clean-off of the front region of the teeth, packaged so as to be carried on the user's person, e.g. in a woman's purse or a man's pocket in a manner that is convenient and sanitary.

It is a further object to provide a brush packaged along with a small quantity of tooth-cleaning compound that can be ingested safely and is non-abrasive to prevent damage to natural tooth material or to dental work such as caps, porcelain veneers, and bonding materials.

It is a further object to provide alternative embodiments directed to particular marketing and vending approaches, including provision for presentation of a promotional matter such as a logo or advertisement.

It is a further object to provide an embodiment of the invention including a breath-freshening ingredient.

SUMMARY OF THE INVENTION

These and other objects have been met by a compact personal package that includes a small brush and a small quantity of specially formulated edible cleaner material. Variations in packaging are provided for maximum personal convenience and for promotional capabilities.

These and other objects and advantages of the present invention will become apparent from the following more detailed description, taken in conjunction with the accompanying drawings which illustrate the invention, by way of example.

DETAILED DESCRIPTION

Figure 1:
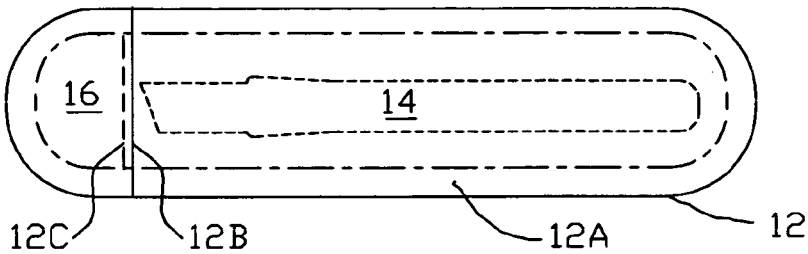
FIG. 1 is a main view of a packaged brush unit in accordance with a first embodiment of the present invention directed to a disposable product intended for one-time usage.

FIG. 1 is a main view of a packaged brush unit 10 in accordance with a first embodiment of the present invention directed to a disposable product intended primarily for one time usage. The package 12 is configured with a conformal top cover 12A, typically of transparent plastic having a peripheral flange by which it is sealed onto a flat cardboard base, enclosing a brush unit 14 whose outline is indicated in broken lines. The top cover 12A is provided with a "snap-open" feature by a scored line 12B for convenient opening. An inner partition 12C forms a compartment at the left hand end containing a quantity of cleaning material 16 in paste form.

Figure 2:
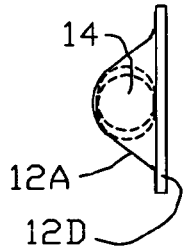
FIG. 2 is a right hand end view of the subject of FIG. 1.

FIG. 2 is a right hand end view of the package 12 of FIG. 1 showing the cardboard base 12D attached peripherally to the top cover 12A which conforms to the outline of the brush unit 14, shown in broken lines.

Figure 3:
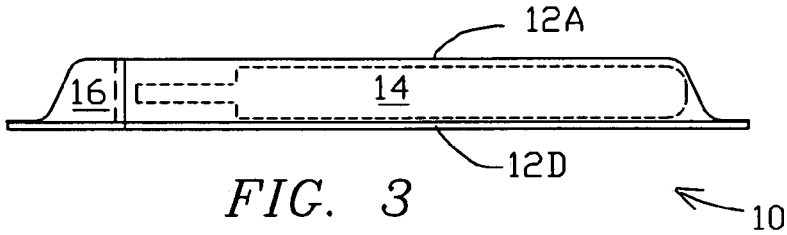
FIG. 3 is a lower side view of the subject of FIG. 1.

FIG. 3, a lower side view of the package of FIG. 1, shows cardboard base 12D attached peripherally to the top cover 12A containing the brush unit 14 whose outline is seen in broken lines and the compartment at the left hand end containing cleaning material 16.

Figure 4:
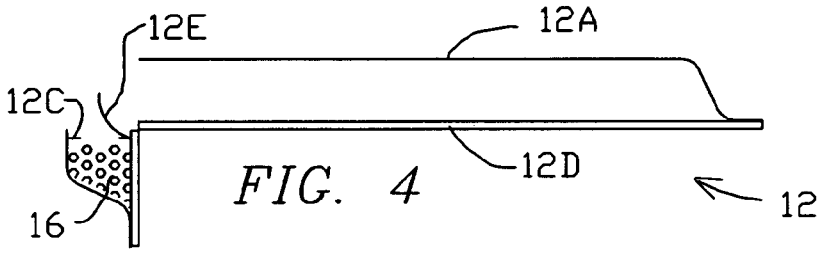
FIG. 4 is a main view of the package of the package of FIG. 1 opened and the brush unit removed.

FIG. 4 is a cross-section taken along the center of package 12, shown after the top cover 12A having been opened at the "snap-open" line (12B FIG. 1) and the brush unit having been removed. The left hand end portion of cardboard base 12D is bent perpendicular so as to locate the partition 12C above the stored cleaning material 16 as shown. A flap 12E, which is initially adhered to the partition 12C in a manner to seal in the cleaning material 16 and prevent it from migrating, has been opened to provide user access to the cleaning material 16 through the opening provided in partition 12C as shown.

Figure 5:
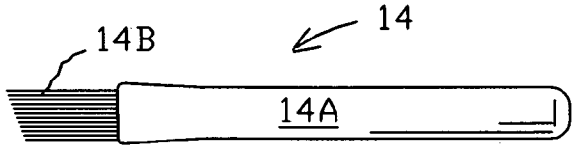
FIG. 5 is a main view of the brush unit from FIGS. 1-3.

FIG. 5 is a main view of the brush unit 14, shown removed from the package as seen from the same viewpoint as in FIG. 1. The generally cylindrical solid plastic handle portion 14A has brush bristles molded into the left hand end to form the brush portion 14B.

Figure 6:
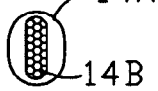
FIG. 6 is a left hand end view of the brush unit of FIG. 5.

FIG. 6 is a left hand end view of the brush unit of FIG. 5 showing the elongated cross-sectional shape of brush portion 14B, which in combination with the angled end shape seen in FIG. 5, facilitates the dental cleaning function, particularly in the upper front and between-the-teeth regions.

Figure 7:
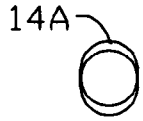
FIG. 7 is a right hand end view of the brush unit of FIG. 5.

FIG. 7 is a right hand end view of the brush unit 14 of FIG. 5, showing the generally circular cross-sectional shape of handle 14A, becoming oval shape at the brush end.

Figure 8:
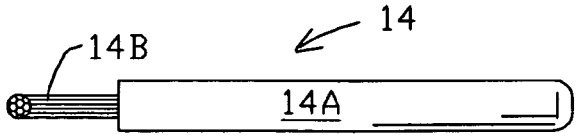
FIG. 8 is a lower side view of the brush unit of FIG. 5.

FIG. 8 is a lower side view of the brush unit 14 of FIG. 5, showing the narrower dimension of the brush portion 14B as seen from this viewpoint.

Figure 9:
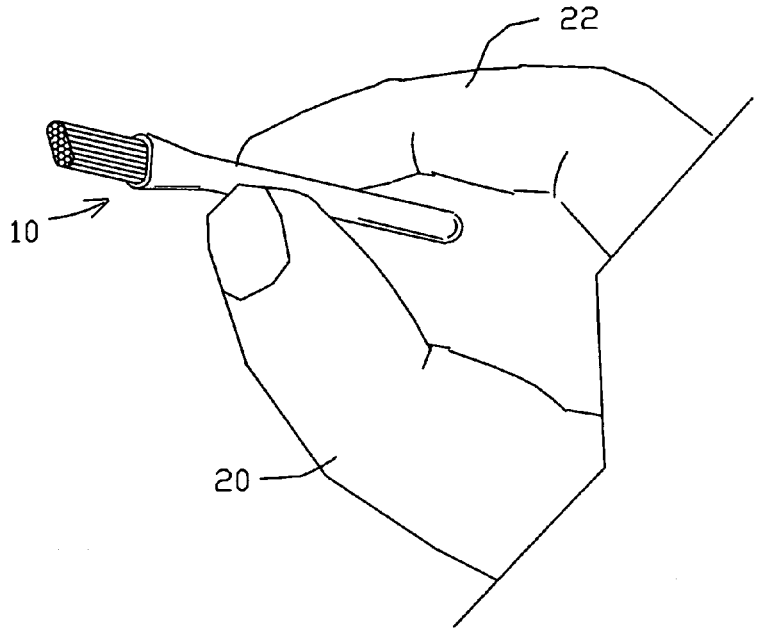
FIG. 9 is a perspective view of the brush unit of FIGS. 6-8 being held by the user.

FIG. 9 is a three-dimensional view of the brush unit 14 of FIGS. 5-8 held by a user between a thumb 20 and a finger 22; typically with the elongated cross-sectional shape of the brush portion 14B oriented in a vertical direction.

Figures 10, 11, 12:
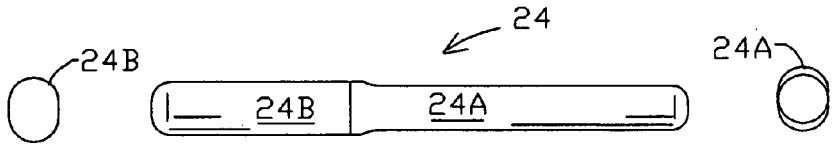
FIG. 10 is a main view of a second embodiment of the present invention directed to a re-usable product.
FIG. 11 is a left hand end view of the subject of FIG. 10.
FIG. 12 is a right hand end view of the subject of FIG. 10.

FIG. 10 is a main view of an enclosed brush unit 24 in a second embodiment of the present invention directed to a re-usable product. The solid plastic handle portion 24A, which is fitted at the left hand end with brush bristles in the same manner as shown in FIGS. 5, 6 and 8, is further configured to fit into a firm cover cap portion 24B, typically made to provide a firm friction fit that effectively seals off the region around the brush bristles inside, and can be made to contain a quantity of cleaning material.

FIG. 11 is a left hand end view of the brush unit 24 of FIG. 9, showing the oval cross-sectional shape of the cap portion 24.

FIG. 12 is a right hand end view of the subject of FIG. 9 showing the circular cross-sectional shape of the handle portion and the oval shape of the cap portion.

Figure 13:
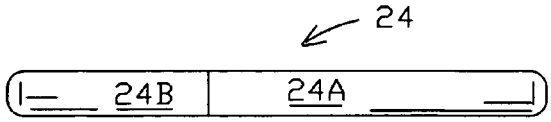
FIG. 13 is a lower side view of the subject of FIG. 10.

FIG. 13 is a lower side view of the brush unit 24 of FIG. 9, showing the substantially uniform thickness of the main handle portion 24A and the cover portion 24B as seen from this viewpoint.

Figure 14:
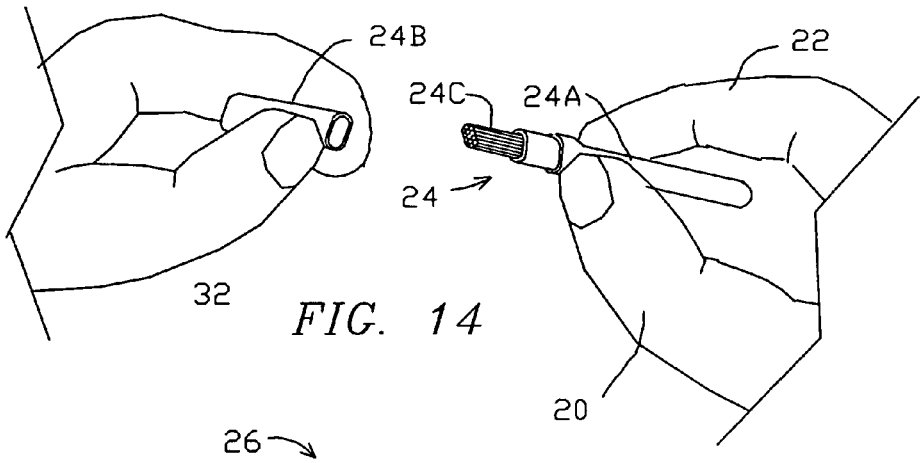
FIG. 14 is a perspective view showing the subject of FIG. 10 with the cover removed for deployment by a user.

FIG. 14 is a three-dimensional view showing the brush unit 24 of FIG. 9 after removal of the cover cap 24B in deployment by the user holding the handle portion 24A between the thumb 20 and finger 22.

Figure 15:
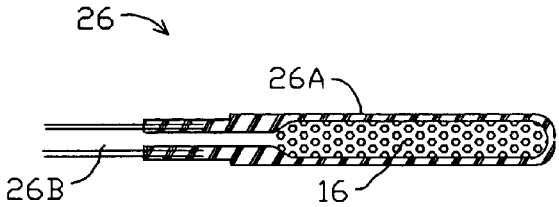
FIG. 15 is a cross-sectional view of a third embodiment of the present invention wherein the handle portion is made hollow to contain cleaning material.

FIG. 15 is a cross-sectional view of a brush unit 26 that constitutes a third embodiment of the present invention wherein the handle portion 26A is made hollow to contain cleaning material 16 in paste form. As shown, a passageway is provided leading to a central opening in the bristle pack of the brush portion 26B.

Figure 16:
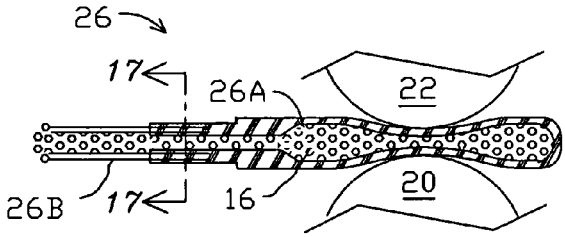
FIG. 16 is a cross-sectional view as in FIG. 15, showing the handle portion compressed by a user to dispense cleaning material to the brush region.

FIG. 16 shows the brush unit 26 of FIG. 14 having been compressed between the thumb 20 and finger 22 of the user causing the cleaning material 16 to move through the passageway to the bristles of the brush portion 26B for performing the dental cleaning function.

Figure 17:
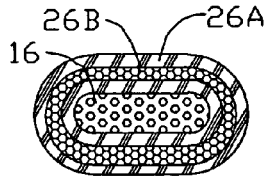
FIG. 17 is an enlarged cross-section taken at 17-17 of FIG. 16.

FIG. 17 is a four times enlarged cross-section taken at 17-17 of FIG. 16 showing the bristles of the brush-head portion 26B embedded between two concentric sleeves of the plastic handle portion 26A, the inner sleeve providing the passageway through which cleaning material 16 is conducted to the brush-head portion 26B, which for this embodiment is configured with the central passageway surrounded by bristles as shown, instead of the solid area of bristles utilized in solid-handle versions (e.g. FIG. 6).

The hollow-handle embodiment shown in FIGS. 15-17 can be directed to either a one-time disposable product or a re-usable product.

Figure 18:
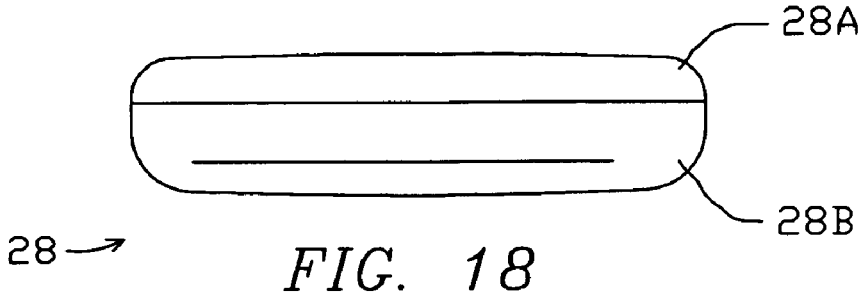
FIG. 18 is a front view of a compact case for articles of the present invention shown in a closed condition.

FIG. 18 is a front view of a container 28 for brush units and cleaning material of the present invention, shown closed.

Figure 19:
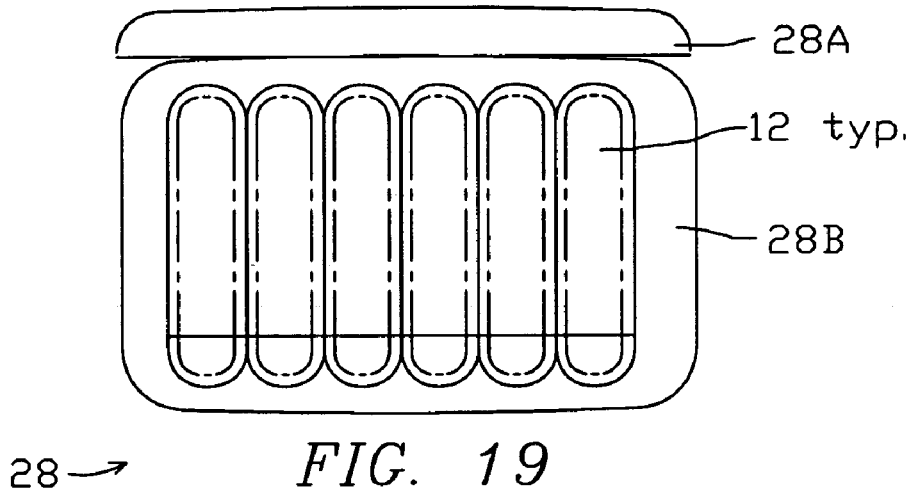
FIG. 19 is a top view of the compact case of FIG. 18, shown open and containing a half dozen disposable brush units packaged with cleaner material as in FIGS. 1-3.

FIG. 19 is a top view of the container 28 of FIG. 18, directed to disposable embodiments of the invention, shown with the cover 28A opened to perpendicular, and containing an array of six packaged brush/cleaning material units 12 as in FIG. 1. These may be procured attached together as shown, and there may be several layers of such six-packs (or other designated multi-pack size).

Figure 20:
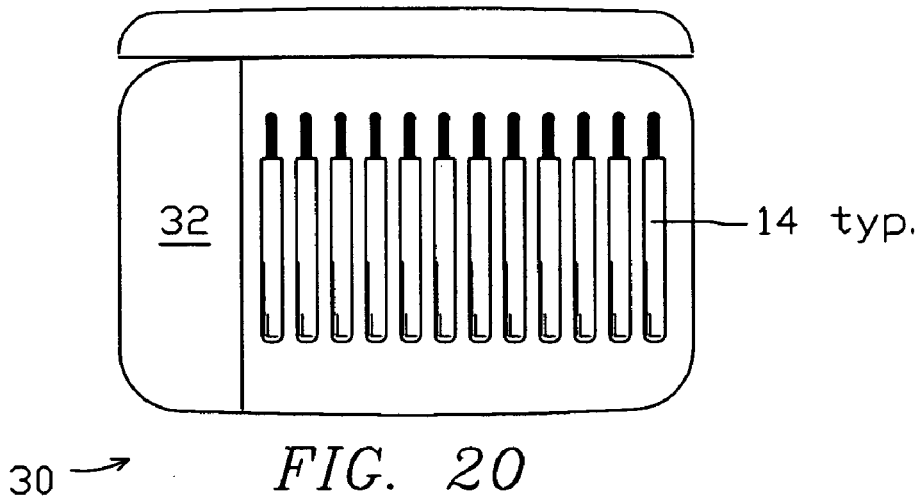
FIG. 20 is an alternate version of the compact case containing a dozen brush units as in FIGS. 10-13 and configured with a compartment for cleaning material.

FIG. 20 is a top view of a container 20, similar to container 18 (FIG. 19) but directed to re-usable embodiments of the invention and shown with a row of twelve brush units 14 as in FIGS. 5-8 along with an amount of cleaning material in a sealable compartment 32.

In a similar manner, container 20 could similarly store brush units of different types such as brush unit 24 (FIGS. 11-14) and unit 26 (FIGS. 15-17). The container 20 could also be provided with a mirror located internally or externally.

With regard to the cleaning material 16, this is selected to effectively dissolve and remove residual material when used immediately after exposure to staining substances, without harmful abrasive action, and to be of a neutral harmless composition that is totally harmless to ingest. The invention could be practiced with cleaning material in powder, liquid, paste or even in solidified form; preferably it may include a breath-freshener and/or distinctive pleasant flavoring.

With regard to the bristles in the bristle head brush, these are made to provide a desired degree of firmness, and may include a mixture of bristles of differing composition and may include auxiliary complementary bristle head structure such as resilient support members. While the embodiments shown are of oval (as in FIGS. 6, 17) or otherwise elongated cross-section in shape, other shapes could be utilized: e.g. round or polygon shapes. The angled cutoff shape shown in FIGS. 1, 7, 9 and 14 is considered to be advantageous, however the invention could be practiced with the end of the bristles cutoff perpendicular to the main body.

As an important marketing feature, the cleaning material 16 can be formulated to also serve as a breath-freshener by the inclusion of suitable ingredients such as mint. Furthermore, the cleaning material can be formulated to provide a distinctive pleasant flavor, or offered in a variety of flavors, with or without the breath-freshening feature As a highly important marketing feature, exposed regions of the package and/or the brush handle may be utilized for advertising or promotional material such as logos and sponsors messages in situations where either the disposable or the re-usable embodiments are sold or offered free as promotional media, for example in restaurants, hotels and the like, alone or along with items already offered such as mints, candy etc. For such commercial purposes, the units may be packed and shipped in bulk quantities that can then be readily dispensed in smaller quantities or individually.

For retail marketing, the units may be suitably packaged in singles or in multiples as required. Typically the multiple units are made in a manner to facilitate bulk handling and shipping while enabling removal of groups or single units at retail or point of usage.

The invention may be practiced with configurations other than those shown as illustrative embodiments, with regard to the shape of the handle, brush and cover cap portions.

In a simplified version of the disposable embodiment shown in FIGS. 1-3, instead of providing the cleaning material separately as shown, it could be already applied onto the brush bristles ready for a single usage as a disposable product.

Packaged units could further include convenience items such as tissues, wet-wipes, dental floss or the like.

The invention may be embodied and practiced in other specific forms without departing from the spirit and essential. characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A supplemental dental cleaning device for use between regular tooth-brushings for prevention of stain by facilitating removal of stain-producing substances immediately following exposures thereto, comprising:

a brush unit having an elongated handle portion and a set of bristles, attached to an end thereof, said set of bristles oriented in a direction substantially parallel to said handle portion;

a quantity of cleaning material provided in portable convenient ready-to-use form along with the brush unit; and a disposable sealed package enclosing the brush unit and the quantity of cleaning material, wherein said sealed package is comprised of a "snap-open" plastic cover portion affixed to a flat cardboard base portion and wherein opening of the disposable sealed package allows both access to the brush unit and exposes a removable seal behind which is enclosed the quantity of cleaning material.

2. The supplemental dental cleaning device as defined in claim 1 further comprising a firm cover cap portion made and arranged to removably attach to the handle portion and to enclose the bristles of the brush portion wherein the cover cap is further made and arranged to contain a designated quantity of the cleaning material in a manner to be conveniently accessible to a user when the cover is removed from the handle portion and further wherein said firm cover cap may be fixedly replaced after use.

3. The supplemental dental cleaning device as defined in claim 1 wherein the handle portion is made hollow and is made to contain a designated quantity of the cleaning material, the handle being configured with a passageway leading to the bristles of the brush portion, and being made resilient such that a user is enabled to deliver cleaning material to the bristles of the brush portion by compressing the handle portion between a thumb and finger.

4. The supplemental dental cleaning device of claim 3 wherein the handle portion is made pliable such that a user may completely collapse said handle portion and wherein the designated quantity of cleaning material is sufficient for only a single use.

5. A supplemental dental cleaning device for use between regular tooth-brushings for prevention of stain by facilitating removal of stain-producing substances immediately following exposures thereto, comprising:

a brush unit having an elongated handle portion and a set of bristles, attached to an end thereof, oriented in a substantially longitudinal direction;

a quantity of cleaning material provided in portable convenient ready-to-use form along with the brush unit;

a disposable sealed package enclosing the brush unit and the quantity of cleaning material, wherein said sealed package is configured with "snap-open" capability for convenient user access to the brush unit and the cleaning material;

a flat cardboard base portion of said sealed package; and a cover portion of the sealed package enclosing the brush unit in a substantially conforming manner and extending to a peripheral flange attached to the base portion in a sealed manner; and an end portion of the sealed package including, a partition forming a compartment containing the cleaning material, the cover portion being configured with a transverse "break-open" score near the partition such that for deployment, the package is made and arranged to break open at the score in response to a user bending the cardboard base in proximity to the score, thus enabling removal of the brush unit and exposing the partition, the partition being configured with a seal flap that can be pulled open to expose an access opening through which the brush can be inserted to place cleaning materials on the bristles.

6. The supplemental dental cleaning device as defined in claim 1 wherein the cleaning material is formulated to be non-abrasive, harmless to ingest, and is provided in paste form.

7. The supplemental dental cleaning device as defined in claim 6 wherein the cleaning material includes a breath-freshening ingredient.

8. The supplemental dental cleaning device as defined in claim 6 wherein the cleaning material is made to have a distinctive pleasant flavor.

9. The supplemental dental cleaning device as defined in claim 5 further comprising a compact container made and arranged to enclose a plurality of the brush units and cleaning material for purposes of convenient personal portability by a user.

10. The supplemental dental cleaning device as defined in claim 5 further comprising a compact container made and arranged to enclose a plurality of the sealed packages as defined in claim 5 for purposes of convenient personal portability by a user.

* * * * *